US006904975B2

(12) United States Patent
Horne et al.

(10) Patent No.: US 6,904,975 B2
(45) Date of Patent: Jun. 14, 2005

(54) INTERVENTIONLESS BI-DIRECTIONAL BARRIER

(75) Inventors: Benjamin Horne, Scotland (GB); David Cameron, Aberdeen (GB)

(73) Assignee: Baker Hughes Incorporated, Houston, TX (US)

( * ) Notice: Subject to any disclaimer, the term of this patent is extended or adjusted under 35 U.S.C. 154(b) by 17 days.

(21) Appl. No.: 10/318,781

(22) Filed: Dec. 13, 2002

(65) Prior Publication Data

US 2003/0173091 A1 Sep. 18, 2003

Related U.S. Application Data

(60) Provisional application No. 60/342,721, filed on Dec. 19, 2001.

(51) Int. Cl.[7] ..... E21B 33/12

(52) U.S. Cl. ..... 166/386; 166/319; 166/321

(58) Field of Search ..... 137/513, 512.3, 137/493.9, 512.2; 166/323, 319, 321, 332.8, 386

(56) References Cited

U.S. PATENT DOCUMENTS

| | | | | | |
|---|---|---|---|---|---|
| 2,241,920 | A | * | 5/1941 | Peterson | 137/315.01 |
| 3,974,848 | A | * | 8/1976 | Wheatley | 137/102 |
| 4,161,985 | A | * | 7/1979 | Fournier et al. | 166/321 |
| 4,474,241 | A | * | 10/1984 | Freeman | 166/317 |
| 4,615,394 | A | | 10/1986 | Kuhlman, Jr. | 166/327 |
| 4,658,902 | A | * | 4/1987 | Wesson et al. | 166/317 |
| 4,729,432 | A | | 3/1988 | Helms | 166/317 |
| 4,846,281 | A | | 7/1989 | Clary et al. | 166/373 |
| 5,310,005 | A | | 5/1994 | Dollison | 166/334 |
| 5,636,661 | A | | 6/1997 | Moyes | 137/614.2 |
| 6,230,808 | B1 | | 5/2001 | French et al. | 166/323 |
| 6,328,109 | B1 | * | 12/2001 | Pringle et al. | 166/373 |

FOREIGN PATENT DOCUMENTS

| | | |
|---|---|---|
| GB | 2 324 849 | 11/1998 |

* cited by examiner

*Primary Examiner*—Hoang Dang
(74) *Attorney, Agent, or Firm*—Cantor Colburn LLP

(57) ABSTRACT

An interventionless bi-directional barrier device of a downhole tool for use in a wellbore and a method of utilizing the barrier device to control the flow of production fluids in the wellbore are described herein. The barrier device includes a flapper mechanism having first and second flappers articulably linked together and articulably linked to a base member that is slidable within the downhole tool. The flapper mechanism provides a seal between opposing uphole-and downhole ends of the downhole tool upon actuation thereof. The method of controlling the flow of production fluids in the wellbore includes closing the barrier device to block flow through the tool, supporting the barrier device from a pressure exerted from a first direction, and supporting the barrier device from a pressure exerted from a second direction.

26 Claims, 11 Drawing Sheets

INTERVENTIONLESS BI-DIRECTIONAL BARRIER

CROSS REFERENCE TO RELATED APPLICATIONS

This application claims the benefit of an earlier filing date from U.S. Provisional Application Ser. No. 60/342,721 filed Dec. 19, 2001, the entire disclosure of which is incorporated herein by reference.

BACKGROUND

Subsurface valves are generally of the hydraulically operated spring loaded rod/piston type for use in the downhole environments of wellbores to regulate the flow of production fluids through the well. The valves provide barriers to restrain the uncontrolled flow of the fluid in the tubing string. Such valves generally provide regulation of fluid flow in the uphole direction as a result of pressure release from a production zone, but may not be adequately operable at extreme depths as a result of an excessive hydrostatic head in the tubing string.

A conventional valve incorporates a flapper mechanism biased to a normally closed position by a spring. Such a flapper mechanism is opened by the application of hydraulic control pressure to a piston that actuates the valve and positions it in an open position. If the hydraulic control pressure is lost, then the valve closes.

Control of such valves is, however, limited by the hydrostatic force applied to the piston. The hydrostatic force applied by the column of fluid in the control line varies with the depth at which the valve is positioned while the counteracting spring force biasing the valve closed is constant. The operability of the valve is, therefore, a function of its location in the well. If the valve is positioned at a depth such that the hydrostatic pressure generated by the column of fluid in the control line or tube is greater than the biasing force exerted by the spring mechanism, the valve will not close in response to a decrease in control pressure.

SUMMARY

An interventionless bi-directional barrier device of a downhole tool for use in a wellbore and a method of utilizing the barrier device to control the flow of production fluids in the wellbore are described herein. The barrier device includes a flapper mechanism having first and second flappers articulably linked together and articulably linked to a base member that is slidable within the downhole tool. The flapper mechanism provides a seal between opposing uphole-and downhole ends of the downhole tool upon actuation thereof. The method of controlling the flow of production fluids in the wellbore includes closing the barrier device to block flow through the tool, supporting the barrier device from a pressure exerted from a first direction, and supporting the barrier device from a pressure exerted from a second direction.

BRIEF DESCRIPTION OF THE DRAWINGS

Referring now to the drawings wherein like elements are numbered alike in the several Figures.

DETAILED DESCRIPTION

Figure 1:
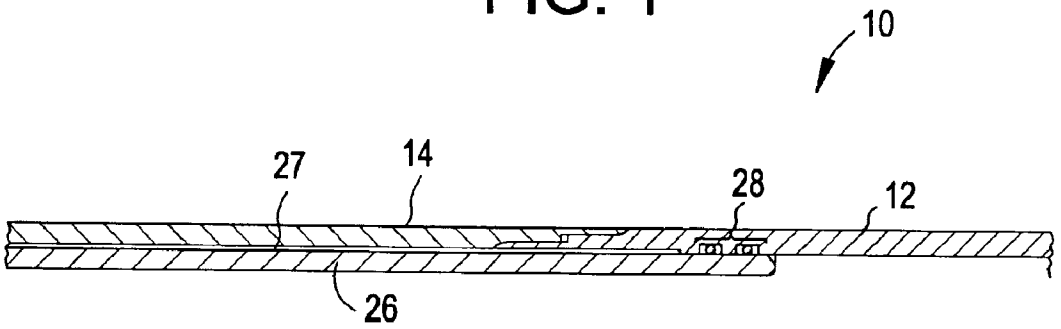
FIG. 1 is a sectional view of a downhole end of a downhole tool showing a piston housing disposed at a bottom sub and an initiating piston annularly disposed therein.

A downhole tool capable of providing control to the production fluids in a wellbore is described herein. The tool is a configuration of concentrically arranged tubular housings adjoined by subs. A bi-directional barrier is cooperably associated with the housings and the subs to control the flow of the production fluids from the downhole environment of the wellbore. In one embodiment, the inner tubular housings of the tool are configured to slide relative to the outer tubular housings of the tool in a telescopic fashion to effect the closure or opening of the bi-directional barrier. In another embodiment the tool may be rotationally actuated to open or close the bi-directional valve. The tool is installable in any position within a wellbore where bi-directional or even signal directional control is desired or required. In its fully open position, the barrier device allows full bore access to the wellbore. Operation of the downhole tool further allows the barrier device to be closed to form a plug capable of holding pressure from above or below the barrier, thereby effectively preventing fluid communication across the barrier. The barrier device may be reopened and full bore access may be re-established upon, for example, completion of a preselected number of tubing pressure cycles, a mechanical or electrical actuation caused from surface or downhole intelligent controller, or other method. The concept set forth above is further elucidated by reference to a specific embodiment thereof discussed hereunder. Those of skill in the art will recognize many substitutional components that do not depart from full scope of this disclosure and appended claims.

Referring now to FIGS. 1 through 7, the downhole tool is shown in portions. The entire tool, hereinafter referred to as "tool 10," comprises a plurality of tubular housings arranged end-to-end (but could be fewer or even one housing if possible from a manufacturing standpoint), as well as various mechanisms slidably disposed within the tubular housings. The various mechanisms regulate fluid flow through tool 10. The outermost geometry of each housing and each sub is of a cross-sectional dimension that allows tool 10 to be received in the tubing string (or in a casing) of the wellbore. The arrangement of tubular housings comprises a bottom sub 12, a piston housing 14 disposed at an upper end of bottom sub 12, a spring housing 16 disposed at an upper end of piston housing 14, a flapper housing 18 disposed at an upper end of spring housing 16, an intermediate sub 20 disposed at an upper end of flapper housing 18, an upper housing 22 disposed at an upper end of intermediate sub 20, and a top sub 24 disposed at an upper end of upper housing 22. It will be understood by those of skill in the art that tool 10 is configured to be oriented in the tubing string of the wellbore such that bottom sub 12 is positioned deeper in the well than top sub 24. It will further be understood by those of skill in the art that any element of tool 10 that is positioned deeper in the well than any other element is said to be "downhole" of the second element, while the second element is said to be "uphole" of the first element.

Referring to FIG. 1, the downhole end of tool 10, particularly bottom sub 12, is shown. Initiating piston 26 is disposed proximate the downhole end of tool 10 and is annularly arranged and slidable within bottom sub 12 and piston housing 14. A first set of o-rings 28 is recessed into bottom sub 12 at an uphole end of bottom sub 12. A chamber 27 is defined between the inner surface of piston housing 14 and the outer surface of initiating piston 26. Chamber 27 is bounded on its downhole end by first set of o-rings 28 and is bounded on its uphole end by a second set of o-rings 30, shown with reference to FIG. 2, and is at atmospheric pressure. Second set of o-rings 30 is recessed into the surface of initiating piston 26 at a point intermediate the opposing ends of initiating piston 26. A third set of o-rings 32 is recessed into piston housing 14 at a point uphole from second set of o-rings 30. Although each set of o-rings 28, 30, 32 is depicted as including two rings, it will be understood by those of skill in the art that any number of o-rings can be employed to define a set of o-rings. In addition, other types of seals capable of holding a pressure differential thereacross may be substituted. A setting port 34 defined by an opening, extends from a chamber 136 at the inner surface of piston housing 14 to the outer surface of piston housing 14.

Figure 2:
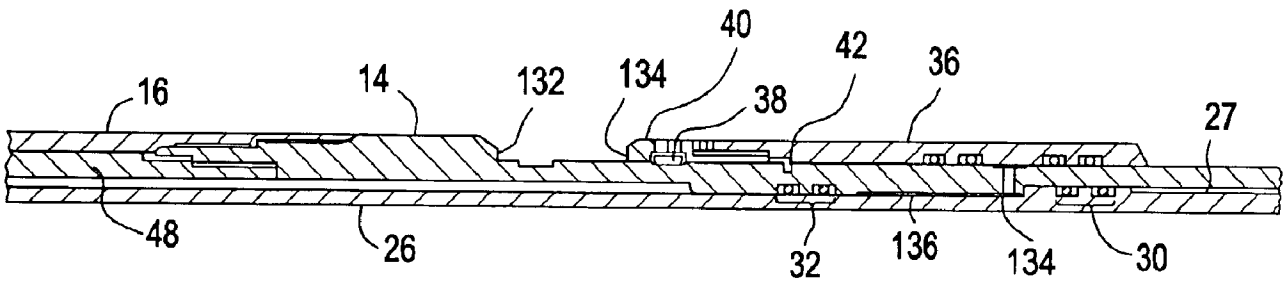
FIG. 2 is a sectional view of a downhole tool showing a set-down sleeve disposed about a piston housing.

A set-down sleeve, shown generally at 36 in FIG. 2, is disposed circumferentially about the outer surface of a cross-section of piston housing 14. Set-down sleeve 36 is retained on the outer surface of piston housing 14 with a snap ring 38. A snap ring retainer 40 positioned at the uphole end of set-down sleeve 36 maintains snap ring 38 and set-down sleeve 36 in their proper respective positions on piston housing 14.

Disposed at an inner surface of set-down sleeve 36 and an outer surface of piston housing 14 is a shear ring 42 (or other selective release mechanism). As is illustrated, shear ring 42 engages the shoulder surface of a notch at the outer surface of piston housing 14. Shear ring 42 is engineered to fail upon the application of a pre-selected amount of stress applied thereto. The failure of shear ring 42 allows for the movement of piston housing 14 relative to set-down sleeve 36 during operation of tool 10, as will be described below.

Figure 3:
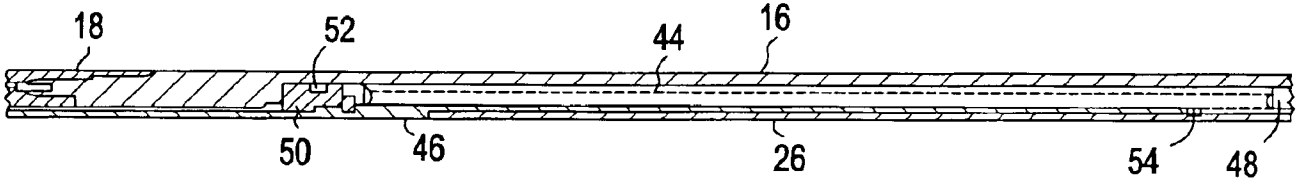
FIG. 3 is a sectional view of a downhole tool showing a spring disposed within a spring housing.

As stated above, spring housing 16 is disposed at the uphole end of piston housing 14. In FIG. 3, a flow tube spring 44 is shown as it would be mounted annularly within spring housing 16 and adjacent to an outer surface of a flow tube 46. A portion of the downhole end of flow tube 46 is, in turn, disposed annularly about the outer surface of the uphole end of initiating piston 26 that extends into flow tube 46 and spring housing 16. Flow tube 46 and initiating piston 26 are disposed in fixed contact with each other at an inner surface of a downhole end of flow tube 46 and an outer surface of an uphole end of initiating piston 26 via a shear screw 54 (or other selective release mechanism). Shear screw 54 is engineered to fail when a pre-selected amount of stress is applied to initiating piston 26 due to hydrostatic pressure at the uphole end of initiation piston 26.

An extension member 48, which is supported at a shoulder surface of piston housing 14 (FIG. 2), supports flow tube spring 44 at a downhole end of flow tube spring 44. A lower spring end stop 50 is annularly disposed at a shoulder in the uphole end of spring housing 16 at an outer surface of flow tube 46 to provide a surface at which flow tube spring 44 can be compressed. A debris barrier 52 is circumferentially disposed in a notch disposed at an outer surface of lower spring end stop 50 to prevent the contamination of flow tube spring 44 with debris, e.g., particulate matter suspended in wellbore fluids flowing through tool 10 during operation of tool 10.

Figure 4:
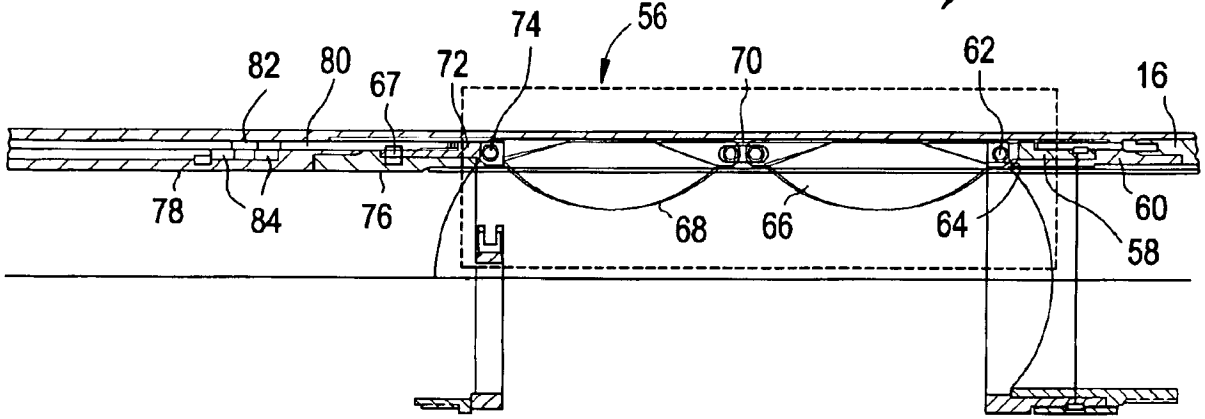
FIG. 4 is a sectional view of a downhole tool showing a flapper mechanism in an open position.

Referring now to FIG. 4, flapper housing 18 is illustrated and described. Flapper housing 18, as stated above, is disposed at the uphole end of spring housing 16. A flapper mechanism, shown generally at 56, is operably disposed within flapper housing 18 to provide for the intervention-less bi-directional control of fluid communication through tool 10. Flapper mechanism 56 is hingedly mounted at a lower base 58 supported by a lower seat 60, which is in turn supported within spring housing 16. The hinged mounting of flapper mechanism 56 at lower base 58 is effected via a lower pin assembly 62. A lower seal 64, fabricated of polytetrafluroethylene, is circumferentially disposed at an uphole end of lower seat 60 to effect the sealing of flapper mechanism 56 from flow tube 46 and prevention of flow through tool 10 upon actuation of flapper mechanism 56.

Flapper mechanism 56 comprises a double flapper including a lower flapper 66 and an upper flapper 68 articulatively linked to each other via a link pin 70. Link pin 70 is retained on flapper 66, 68 with pins (not shown) and nuts (not shown). As stated above, the downhole end of lower flapper 66 is hingedly connected at lower base 58 via lower pin assembly 62. Lower pin assembly 62 comprises an alignment rod (not shown) supported through the downhole end of lower flapper 66. Torsion springs (not shown) urge the flappers against the seats. The flow tube holds the flappers back against the flapper housing. The uphole end of upper flapper 68 is hingedly connected at an upper base 72 with an upper pin assembly 74. Upper base 72 is fixedly disposed at an upper seat 76, which is in turn fixedly disposed at an upper seat extension 78. Upper pin assembly 74 is substantially similar to lower pin assembly 62. Upper seat extension 78 is slidably and annularly disposed within flapper housing 18, intermediate sub 20, and upper housing 22. An upper seal 65, which may be fabricated of polytetrafluroethylene, is circumferentially disposed at a downhole end of upper seat 76 to effect the sealing of flapper mechanism 56 from the portion of tool 10 uphole of flapper mechanism 56.

An upper base extension 80 is also fixedly disposed at upper seat 76. Upper base extension 80 includes two slots (not shown) milled into a surface thereof. The first slot extends in a straight line longitudinally along the length of upper base extension 80. An upper seat pin 67 disposed in upper seat 76 engages the first slot and maintains the alignment of upper seat 76 and upper base 72. Translation of upper seat pin 67 along the first slot ensures that the sinusoidal profiles of upper seat 76 and upper flapper 68 are aligned during operation of tool 10. A seat control pin 82 disposed at a seat control ring 84 disposed circumferentially about upper seat extension 78 is received in the second slot, which is profiled. Engagement of the second slot by seat control pin 82 causes seat control ring 84 to rotate as upper base extension 80 translates in the downhole direction during the opening of flapper mechanism 56.

Figure 5:
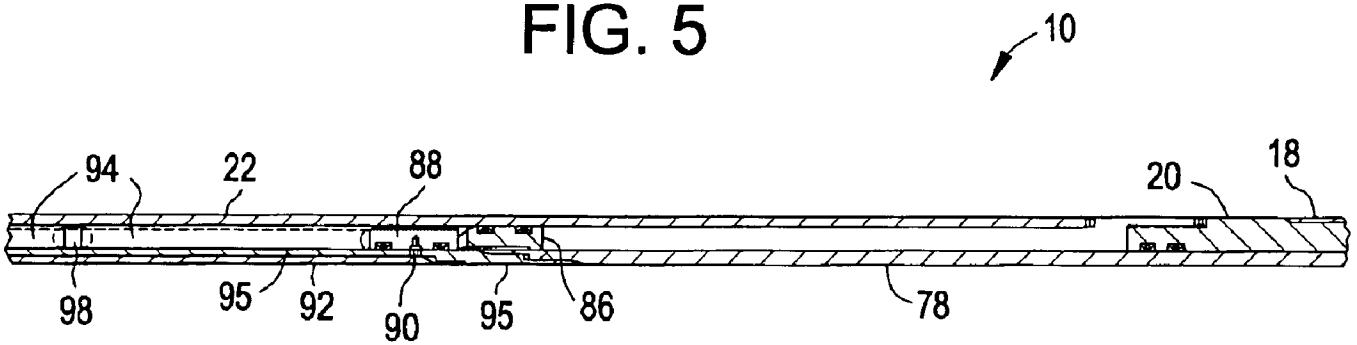
FIG. 5 is a sectional view of a downhole tool showing a body lock ring slidably disposed within an upper housing.
Figure 6:
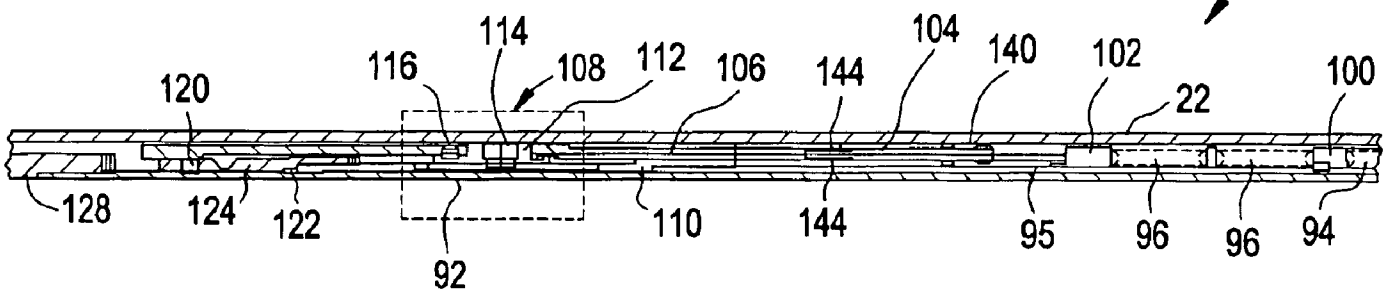
FIG. 6 is a sectional view of a downhole tool showing an upper housing having J-slot springs, a J-slot control ring, and a J-slot pin slidably disposed within the upper housing.

Referring now to FIGS. 5 and 6, a lock ring support 86 is supported by an inner mandrel 95 at an uphole end of upper seat extension 78. Lock ring support 86 is positioned within upper housing 22. A body lock ring 88 disposed uphole of lock ring support 86 is held in place by lower dogs 90 supported on a dog support mandrel 92 annularly positioned within inner mandrel 95. Opening springs 94, J-slot springs 96, a spring separator 98, a spring retainer 100, and an upper spring end stop 102 are positioned between the inner surface of upper housing 22 and the outer surface of inner mandrel 95. A piston 104 supported in a cylinder sub 140 disposed between upper housing 22 and inner mandrel 95 effects the compression of springs 96 during operation of tool 10. Dynamic seals 144 are disposed at the uphole end of piston 104.

A hook mandrel 106 is supported at the uphole end of piston 104. Hook mandrel 106 is in communication with a J-slot ring/pin assembly 108 disposed at a J-slot sub 110 supported within upper housing 22 by dog support mandrel 92. J-slot ring/pin assembly 108 comprises a J-slot control ring 112 slidably disposed about an outer surface of J-slot sub 110. A J-slot pin 114 is retained in a groove that extends circumferentially about the outer surface of J-slot control ring 112. A J-slot C-ring 116 also extends circumferentially about the outer surface of J-slot control ring 112.

Figure 7:
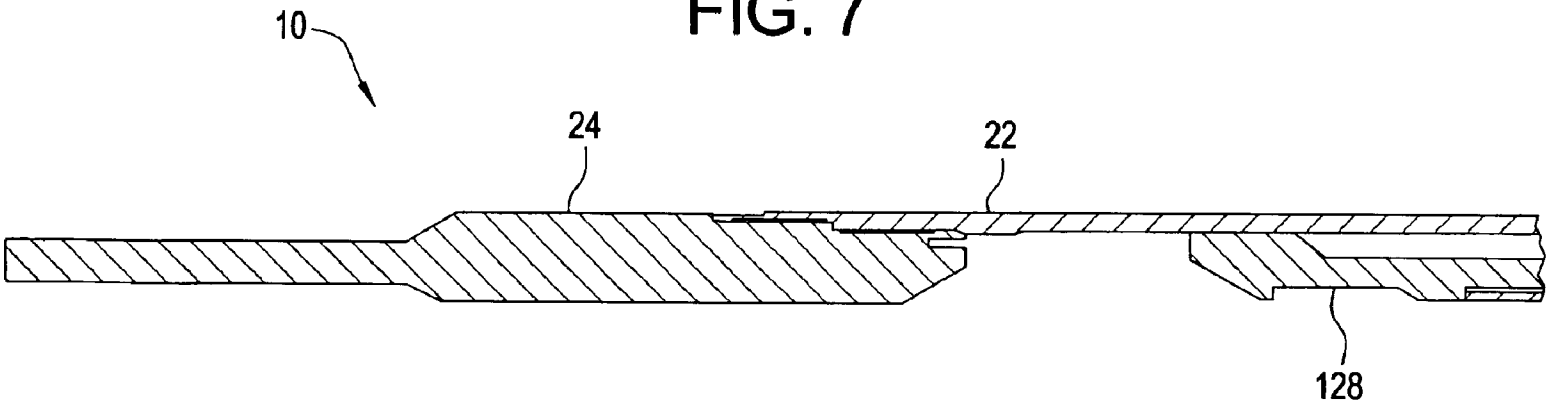
FIG. 7 is a sectional view of an uphole end of a downhole tool showing a top sub disposed at an upper housing.

J-slot sub 110 includes a slot (not shown) having a milled profile. An upper dog retainer 118 having upper dogs 120 extending laterally therefrom is slidably supported between upper housing 22 and dog support mandrel 92 and is in drivable communication with J-slot ring/pin assembly 108. A split ring 122 retains an upper dog housing 124 between upper dog retainer 118 and dog support mandrel 92. An opening sub 128 is supported at the uphole end of dog support mandrel 92. Top sub 24 is shown in FIG. 7 as it would be disposed at upper housing 22.

The operation of tool 10 is described with reference to FIGS. 8 through 19. In general, the operation of tool 10 comprises running tool 10 into a wellbore, closing flapper mechanism 56, locking flapper mechanism 56 closed, performing the relevant wellbore operations as determined by an operator of tool 10, and opening flapper mechanism 56 subsequent to the completion of the wellbore operations.

The running of tool 10 into the wellbore is referred to as the initiation phase and is described with reference to FIG. 8. In the initiation phase, tool 10 is run into the wellbore to a depth such that set-down sleeve 36 engages a liner top 130 positioned within the wellbore. When a sufficient amount of weight is "slacked off," shear ring 42 will shear. Once shear ring 42 shears, set-down sleeve 36 is slidably translatable along the outer surface of piston housing 14 between the top edge of liner top 130 and a shoulder surface, shown at 132 in FIGS. 2 and 8. Tool 10 can then be further inserted into the wellbore until shoulder surface 132 engages a shoulder surface, shown at 134 in FIGS. 2 and 8, on the uphole end of set-down sleeve 36.

Once shoulder surface 132 engages shoulder surface 134 and tool 10 is fully inserted into the wellbore, setting port 34 is disposed at the engagement of shoulder surface 132 and shoulder surface 134. Because the inner surface of liner top 130 and the outer surface of initiating piston 26 are only loosely engaged, fluid communication is maintained therebetween. Such fluid communication typically comprises the flow of wellbore fluids. Because setting port 34 is disposed at the engagement of shoulder surface 132 and shoulder surface 134, fluid communication can be maintained across setting port 34 with chamber 136 defined between the inner surface of piston housing 14 and the outer surface of initiating piston 26 and bounded on opposing ends by second set of o-rings 30 and third set of o-rings 32. The fluid communication maintained across setting port 34 with chamber 136, which is at hydrostatic pressure, causes chamber 136 to expand and drives initiating piston 26 in the downhole direction. As initiating piston 26 is driven in the downhole direction, initiating piston 26, which is connected at its uphole end to the downhole end of flow tube 46 via shear screw 54, pulls flow tube 46 in the downhole direction and compresses flow tube spring 44. Flow tube 46 is pulled in the downhole direction until flow tube 46 engages a shoulder surface 138 on piston housing 14.

Figure 8:
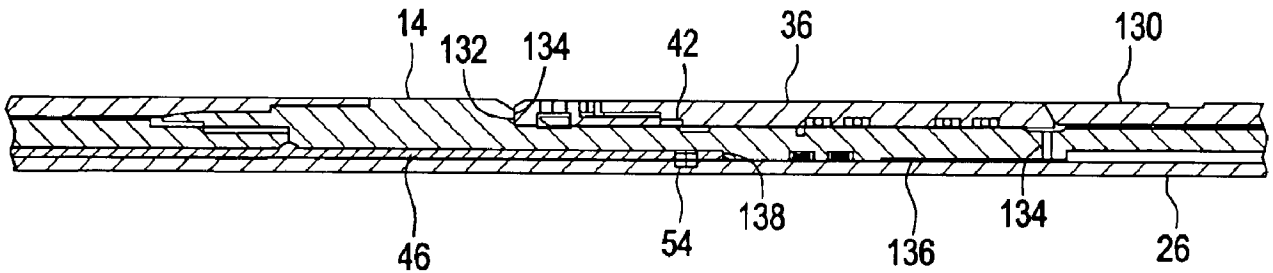
FIG. 8 is a sectional view of a downhole tool in which a set-down sleeve disposed at a piston housing is inserted into a wellbore.
Figure 9:
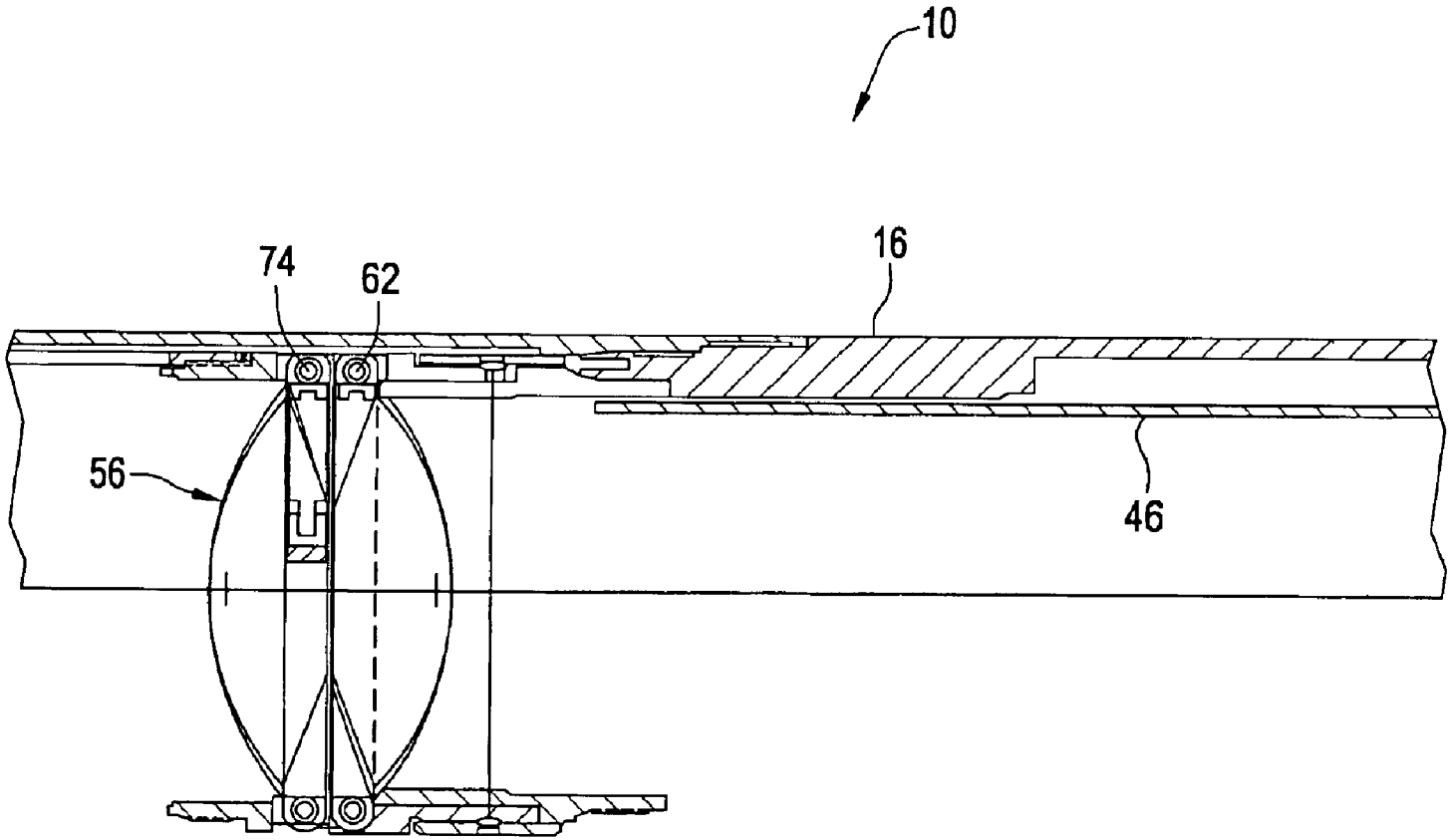
FIG. 9 is a sectional view of a downhole tool in which a flapper mechanism is closed.

Referring now specifically to FIGS. 8 and 9, the closing of flapper mechanism 56 to effectively prevent the flow of wellbore fluids through tool 10 is shown. In closing flapper mechanism 56, the movement of flow tube 46 in the downhole direction pulls the uphole end of flow tube 46 clear of flapper mechanism 56. Once flow tube 46 is clear of flapper mechanism 56, flappers 66,68 are free to collapse and swing closed under the action of the torsion springs of lower pin assembly 62 and upper pin assembly 74.

The hydrostatic pressure continues to act on initiating piston 26 even after flow tube 46 engages shoulder surface 138 on piston housing 14. Such hydrostatic pressure continues to bias initiating piston 26 in the downhole direction within the inside diameter liner top 130, while flow tube 46 and piston housing 14 remain biased on the top edge of liner top 130. The continued pressure exerted on initiating piston 26 causes shear screw 54, which maintains the connection between initiating piston 26 and flow tube 46, to shear (or otherwise release, as noted above).

Figure 10:
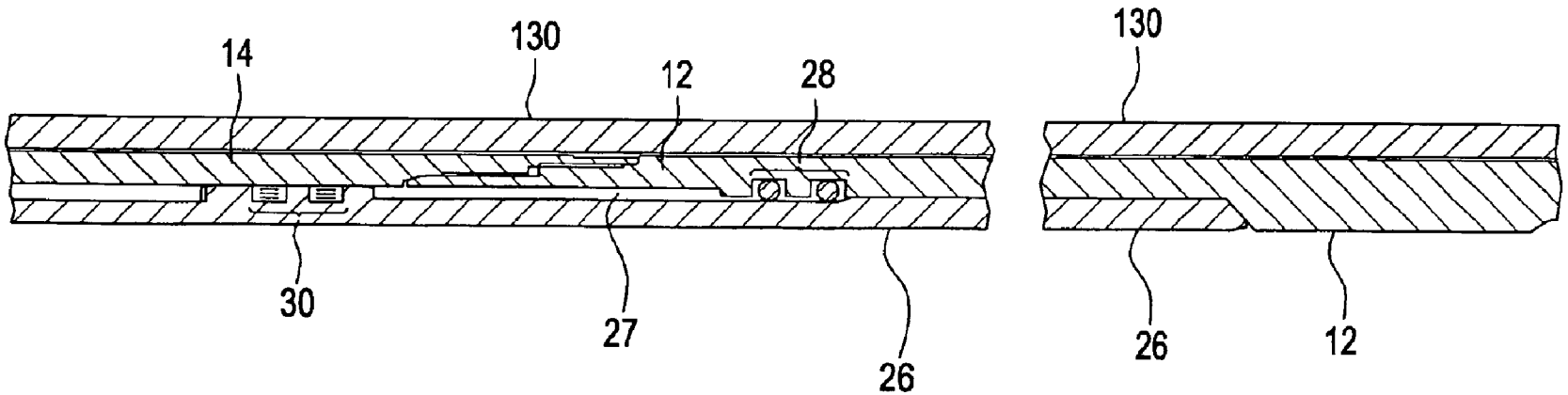
FIG. 10 is a sectional view of a downhole tool in which an initiating piston slidably disposed within a bottom sub is engaged with a shoulder surface of the bottom sub.
Figure 11:
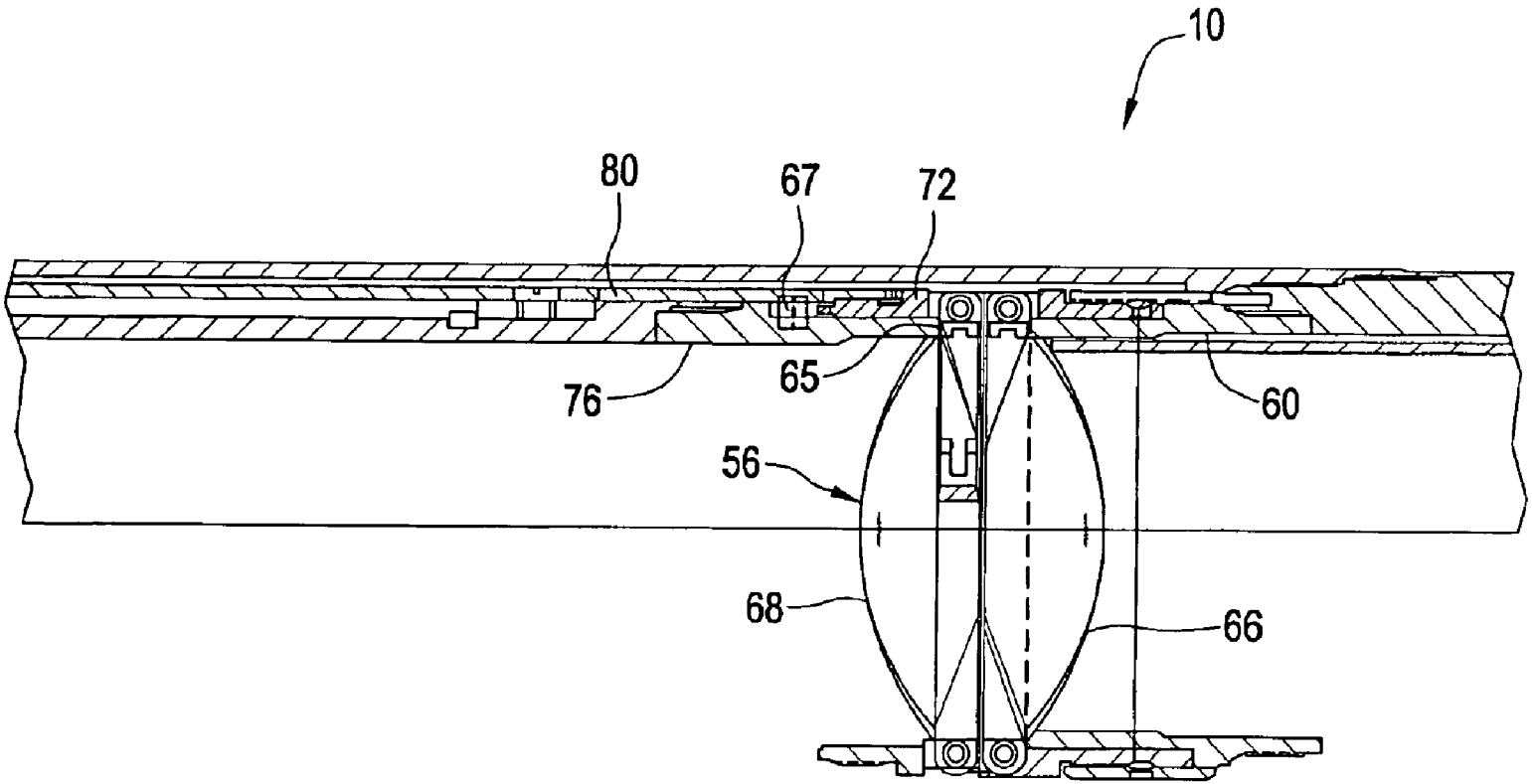
FIG. 11 is a sectional view of a downhole tool in which a flapper mechanism is engaged by a flow tube from a downhole direction to support the flapper mechanism from the downhole direction.

Initiating piston 26 then continues to move in the downhole direction reducing the volume of chamber 27, as is shown in FIG. 10. As the volume of chamber 27 is reduced, the pressure therein is increased until first set of o-rings 28 unseats, thereby relieving the pressure in chamber 27 and causing chamber 27 to flood with wellbore fluids. At this point, initiating piston 26 may engage bottom sub 12. Once shear screw 54 shears, the compression of flow tube spring 44 is relieved and flow tube 46 is driven in the uphole direction until the uphole end of flow tube 46 engages flapper mechanism 56, as is shown in FIG. 11. Once flapper mechanism 56 is closed, lower flapper 66 engages lower seal 64 on lower seat 60, thereby rendering flapper mechanism 56 capable of holding pressure from the uphole direction. Because of the geometry of flapper mechanism 56, flow tube 46 is prevented from forcing flapper mechanism 56 to open.

Still referring to FIG. 11, after flapper mechanism 56 is closed, flapper mechanism 56 is locked. To lock flapper mechanism 56, the tubing string is pressurized such that a pressure is exerted on lower flapper 66. Such a pressurization creates a pressure differential across the area between the outer seals of the cylinder sub and the seals of the intermediate sub and causes the translation of the componentry uphole of flapper mechanism 56 in the downhole direction until upper seat 76 engages upper flapper 68 via upper seal 65. During the translation of the componentry in the downhole direction, upper seat 76 and upper base 72 translate in the downhole direction. As stated above, the engagement of upper seat pin 67 with the first slot milled into upper base extension 80 maintains the alignment of upper seat 76 and upper base 72 to ensure that the sinusoidal profiles on upper seat 76 and upper flapper 68 are properly aligned during operation of tool 10.

Figure 12:
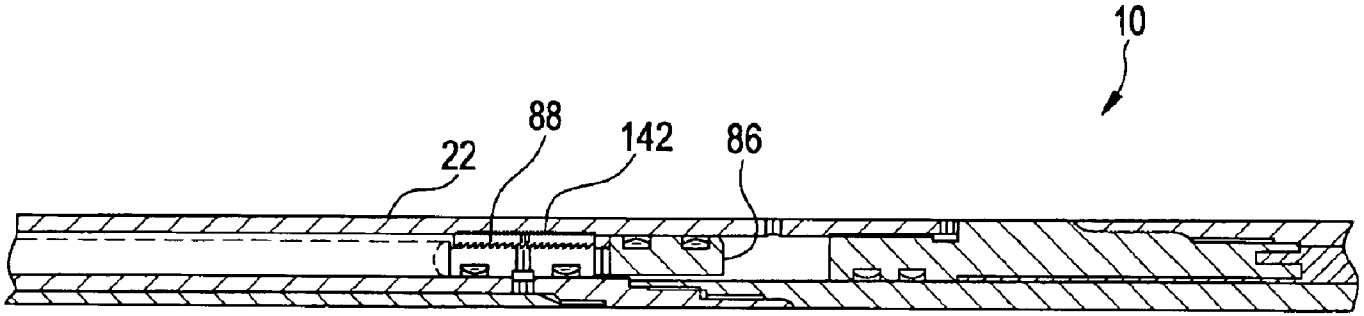
FIG. 12 is a sectional view of a downhole tool in which a lock ring is translated in a downhole direction to support a flapper mechanism from an uphole direction.
Figure 13:
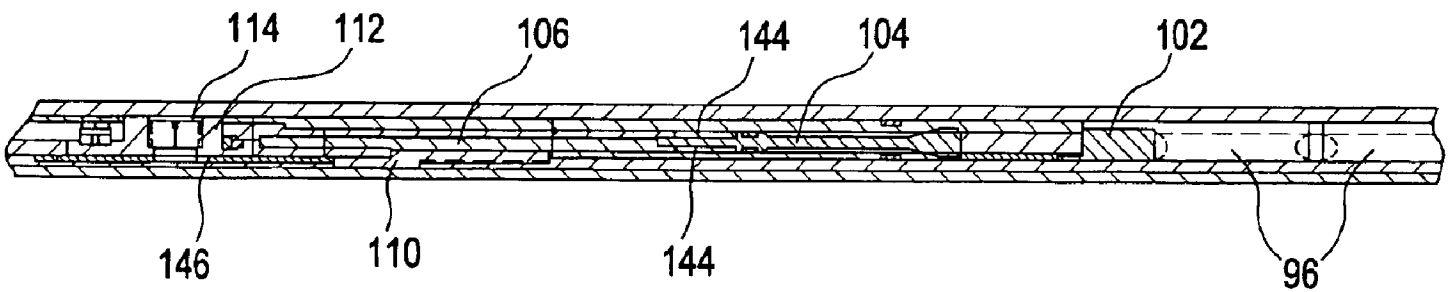
FIG. 13 is a sectional view of a downhole tool in which a J-slot ring and a J-slot pin are translated in a downhole direction to effect the closing of a flapper mechanism.

Referring now to FIG. 12, as lock ring support 86 translates downhole, body lock ring 88 attached to lock ring support 86 engages a set of teeth which may be one way threads and in one embodiment are wicker threads 142 disposed at an inner surface of upper housing 22. Wicker threads 142 are configured such that body lock ring 88 is prevented from moving in the uphole direction upon an application of pressure from the wellbore downhole from wicker threads 142. At such a point, flapper mechanism 56 is sandwiched between lower seat 60 and upper seat 76 and locked closed, as shown in FIG. 11, thereby allowing flapper mechanism 56 to support tubing pressure from either the uphole direction or the downhole direction. Wellbore operations can then be undertaken.

Once the wellbore operations requiring closure of tool 10 are complete, tool 10 can be opened. Although tool 10 can be opened in a number of different ways, one way of causing tool 10 to open is the application of tubing pressure cycles uphole of flapper mechanism 56 allowing for the indexing of the opening mechanism. The opening mechanism may be actuated upon the application of pressures of up to about 3000 psi or greater.

The opening mechanism employs a ratcheting scheme to retract flappers 66, 68 back against the inner surface of flapper housing 18, as is shown and described with reference to FIGS. 13 through 18. To actuate the opening mechanism with the ratcheting scheme, pressure is applied to the tubing uphole of flapper mechanism 56. Such pressure acts across dynamic seals 144 (FIG. 13) in the downhole direction to drive piston 104 downhole, thereby compressing J-slot springs 96 via upper spring end stop 102. As piston 104 is driven downhole, piston 104 pulls hook mandrel 106, which in turn pulls J-slot control ring 112. J-slot pin 114 disposed in J-slot control ring 112 engages a milled profile 146 on J-slot sub 110. As J-slot control ring 112 translates along J-slot sub 110 in the downhole direction, J-slot pin 114 follows milled profile 146, thereby causing J-slot control ring 112 to rotate. If the tubing pressure in the wellbore is great enough to compress the J-slot spring sufficiently, J-slot control ring 112 will translate downhole (while rotating) until J-slot pin 114 engages a lower limit of milled profile 146 in J-slot sub 110.

Figure 14:
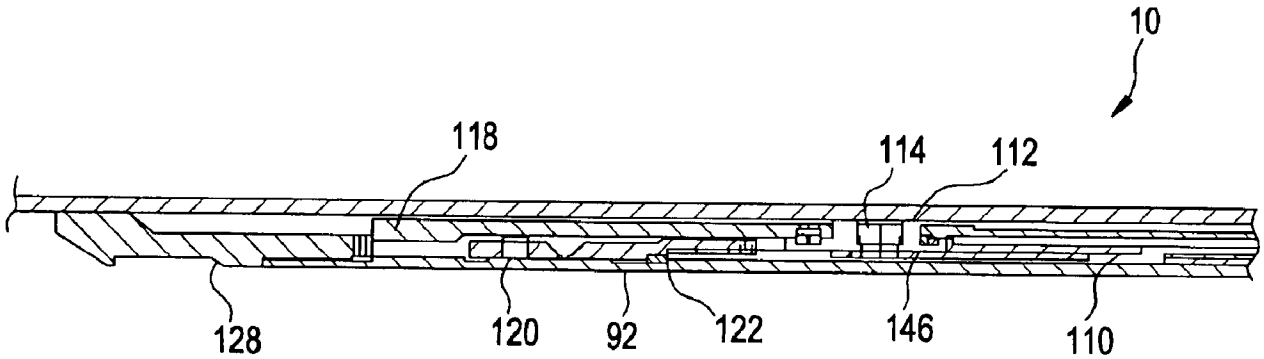
FIG. 14 is a sectional view of a downhole tool in which a J-slot ring and a J-slot pin are translated in an uphole direction to effect the opening of a flapper mechanism.
Figure 15:
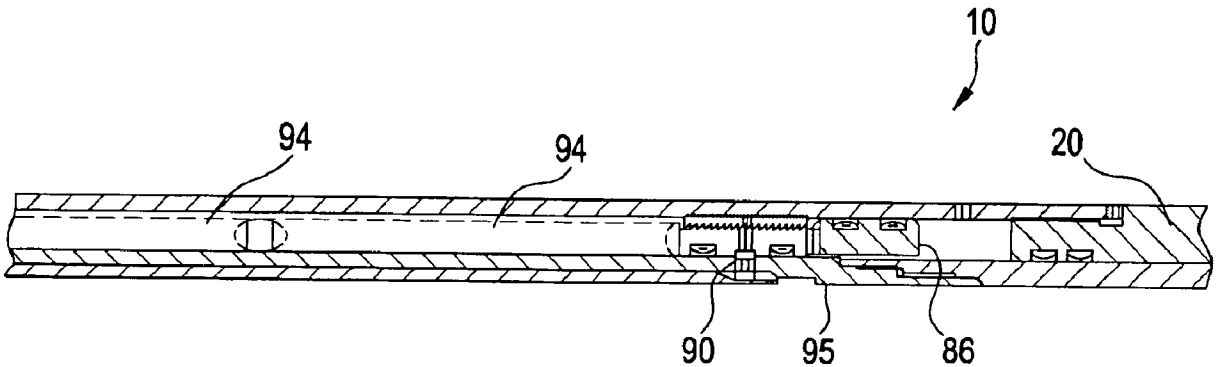
FIG. 15 is a sectional view of a downhole tool in which an uphole translation of a J-slot ring and a J-slot pin effect the un-supporting of a lower dog.

Referring to FIG. 14, upon bleeding the tubing pressure off, piston 104 is biased in the uphole direction in response to the loading of J-slot spring 96. J-slot control ring 112 then translates in the uphole direction while rotating in response to engagement of J-slot pin 112 in the milled profile on J-slot sub 110. The bleeding off of the tubing pressure and the movement of J-slot control ring 112 in the uphole direction can be effected a pre-selected number of times without opening the flapper mechanism. The illustrated exemplary embodiment of tool 10 is configured to enable the pressure to be bled off seven times without opening flapper mechanism 56. The upward translation of J-slot control ring 112 is limited by the engagement of J-slot pin 114 with the top edge of the profile on J-slot sub 110. It will be understood by one of skill in the art that as many or as few steps as desired may be built into J-slot control ring 112.

In the illustrated exemplary embodiment, on bleeding off the tubing pressure after the eighth time, J-slot pin 114 engages a section of milled profile 146 that enables J-slot control ring 112 to translate in the uphole direction until J-slot control ring 112 engages the downhole end of upper dog retainer 118 and biases upper dog retainer 118 in the uphole direction. Upper dog retainer 118 is translated in the uphole direction until upper dog retainer 118 engages opening sub 128.

Figure 16:
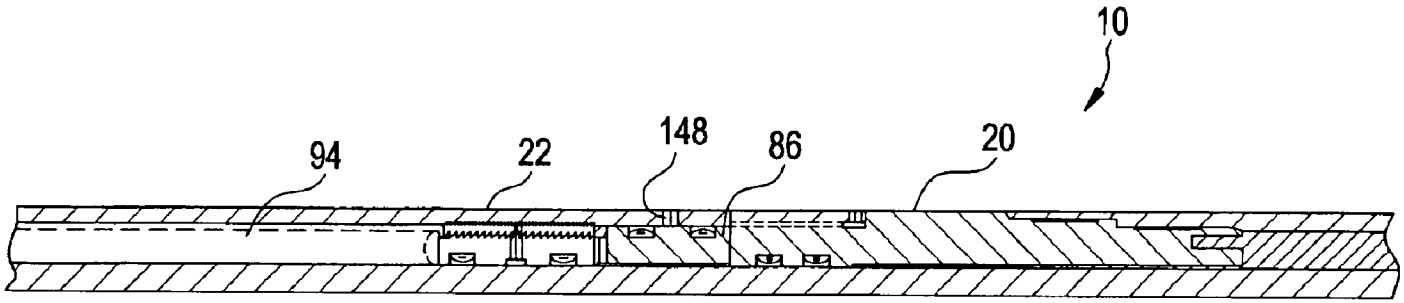
FIG. 16 is a sectional view of a downhole tool in which a lock ring is engaged with an intermediate sub.

The load exerted on opening sub 128 by the translation of upper dog retainer 118 in the uphole direction biases opening sub 128 in the uphole direction. When upper dog retainer 118 moves clear of upper dog 120, opening sub 128 and dog support mandrel 92 move uphole until dog support mandrel 92 engages split ring 122. Such upward movement causes lower dog 90 to be de-supported, as is shown with reference to FIG. 15, thereby allowing lower dog 90 to extend through windows in inner mandrel 95 to effectively de-couple inner mandrel 95 from lock ring support 86. Opening springs 94 are then free to pull the flapper mechanism open by driving lock ring support 86 in the downhole direction to engage intermediate sub 20, as is shown in FIG. 16. The engagement of lock ring support 86 with intermediate sub 20 effectively closes off a port 148 disposed in upper housing 22 that provides fluid communication between the tubing string (in which tool 10 is disposed) and the annulus of the wellbore.

Figure 17:
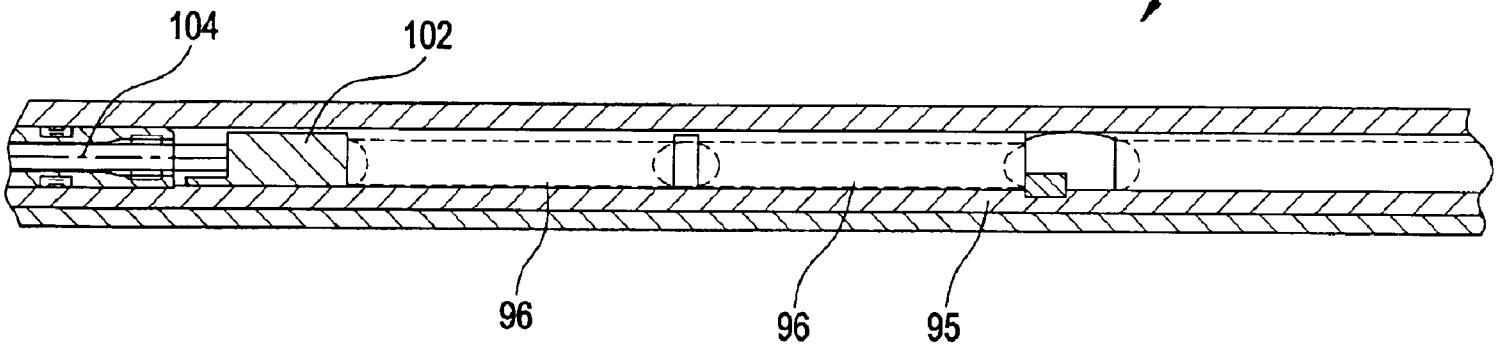
FIG. 17 is a sectional view of a downhole tool in which opening springs drive an inner mandrel in an uphole direction.
Figure 18:
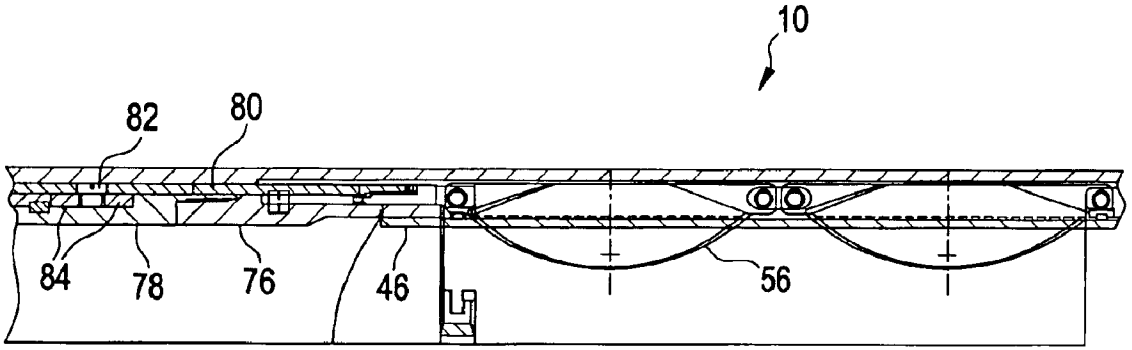
FIG. 18 is a sectional view of a downhole tool in which an upper seat and an upper seat extension translate in an uphole direction to open a flapper mechanism.

Simultaneous with the engagement of lock ring port 86 with intermediate sub 20, opening springs 94 drive inner mandrel 95 in the uphole direction, as shown in FIG. 17. Because opening springs 94 are in mechanical communication with inner mandrel 95 via retainer segments 150 disposed at spring retainers 100, the upward movement of inner mandrel 95 causes upper seat 76 and upper seat extension 78 to also move in the uphole direction, as is shown in FIG. 18. As upper seat extension 78 translates in the uphole direction, seat control ring 84 is likewise pulled in the uphole direction. Seat control pin 82 thereby engages the profiled slot at upper base extension 80. As seat control pin 82 is pulled in the uphole direction through the profiled slot, flapper mechanism 56 is pulled into the open position. As flapper mechanism 56 opens, flow tube 46 is biased in the uphole direction as a result of the decompression of the flow tube spring. Once flapper mechanism 56 is fully open, flow tube 46 maintains flapper mechanism 56 in the open position, and flow can be maintained through tool 10. Normal operation of the wellbore can then be resumed.

Figure 19:
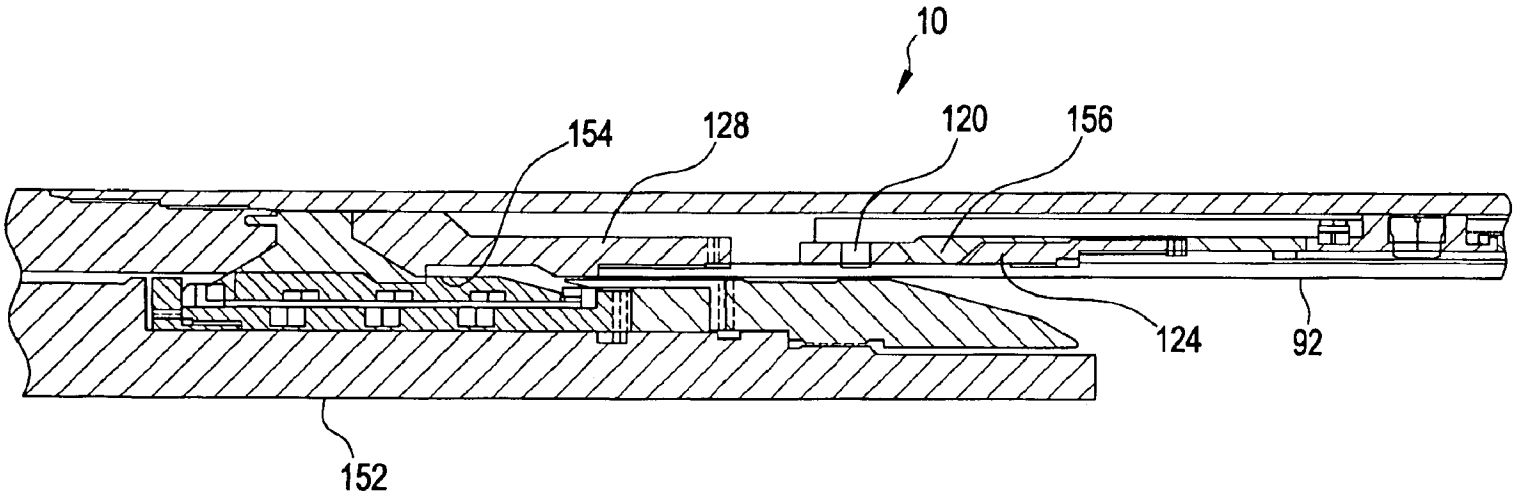
FIG. 19 is a sectional view of a manual shifting tool inserted into a downhole tool.

Referring now to FIG. 19, a mechanical intervention procedure for opening the flapper mechanism is described and illustrated. Mechanical intervention may be required when tool 10 does not open in response to repeated tubing pressure cycles or when an operator of tool deems it necessary or desirable to open the flapper mechanism manually. In the mechanical intervention procedure, a shifting tool 152 is run into the uphole end of tool 10. A tab 154 extending from shifting tool 152 engages a profile disposed at the inner surface of opening sub 128. By biasing shifting tool 152 in the uphole direction, load can be applied to opening sub 128, through dog support mandrel 92, into upper dog 120, and into upper dog housing 124. Such load is transmitted through tool 10 through the J-slot sub and the inner mandrel to the body lock ring. When the applied load is sufficient (i.e., reaches a pre-calculated limit), a calibrated parting section 156 fails allowing opening sub 128 and dog support mandrel 92 to be moved in the uphole direction, thereby un-supporting the lower dog. The lower dog, in a manner similar to that as described above, drops through the window in the inner mandrel, de-coupling the inner mandrel from the lock ring support. The opening springs then drive the inner mandrel upward, pulling the upper seat, the upper seat extension, and the seat control ring. The seat control pin engages the profiled slot on the upper base extension and pulls the upper base and the flapper mechanism into the open position, allowing the flow tube to extend upward and retain the flapper mechanism in the open position, thereby opening tool 10. Once fully opened, shifting tool 152 is manually disengaged from opening sub 128 and retracted from the wellbore.

While the disclosure has been described with reference to a preferred embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A downhole tool, comprising:

a tubular housing;

a piston disposed within said tubular housing;

a flow tube disposed at said piston; and a bi-directional double flapper mechanism capable of preventing fluid flow in both directions disposed in cooperable communication with said flow tube.

2. The downhole tool as claimed in claim 1, further comprising a spring disposed at said flow tube, said spring being configured to be compressed upon biasing said flow tube in a downhole direction.

3. The downhole tool of claim 2, wherein a downhole facing starface of said hi-directional flapper mechanism is engageable by a lower seat and base assembly.

4. The downhole tool as claimed in claim 1, further comprising a lock ring engageable with an uphole facing surface of said bi-directional flapper mechanism, said lock ring being configured to support pressure exerted on said bi-directional flapper mechanism from a downhole direction.

5. The downhole tool as claimed in claim 1 wherein said bi-directional double flapper mechanism is configured to be disengagable by a shifting tool insertable into said downhole tool.

6. A downhole tool, comprising:

a tubular housing;

a piston disposed within said tubular housing;

a flow tube disposed at said piston;

a bi-directional flapper mechanism disposed in cooperable communication with said flow tube;

a lock ring engageable with an uphole facing surface of said bi-directional flapper mechanism, said lock ring being configured to support pressure exerted on said bi-directional flapper mechanism from a downhole direction; and a set of teeth engageable by said lock ring, the engagement of said lock ring and said teeth providing the support of the pressure excited on said bi-directional flapper mechanism from the downhole direction.

7. The downhole tool as claimed in claim 6, further comprising a ratcheting mechanism configured to disengage said lock ring from said teeth.

8. The downhole tool as claimed in claim 7 wherein said ratcheting mechanism comprises:

a piston, said piston being actuatable upon a pressurization;

a spring configured to be biased by said piston;

a pin disposed in operable communication with said spring; and a profiled slot engageable by said pin.

9. The downhole tool as claimed in claim 6 wherein said teeth are a one way thread.

10. The downhole tool as claimed in claim 6 said teeth are wicker threads.

11. A bi-directional barrier device for a downhole tool positionable in a wellbore, said barrier comprising:

a flapper mechanism configured to provide a seal between opposing uphole-and downhole ends of said downhole tool upon actuation of said flapper mechanism, said flapper mechanism comprising, a first flapper, and a second flapper articulably linked to said first flapper, said second flapper further being articulably linked to a base member, said base member being movable within said downhole tool.

12. The bi-directional barrier device as claimed in claim 11, wherein said flapper mechanism further comprises a locking device configured to support pressure exerted on said flapper mechanism from a first direction, and wherein said flapper mechanism further comprises a surface to support pressure exerted on said flapper mechanism from a second direction.

13. The barrier device as claimed in claim 12, wherein said locking device comprises a dog supported on a mandrel, said dog being configured to maintain said locking device in a locked configuration.

14. A method of controlling a flow of production fluids in a wellbore, the method comprising:

closing a barrier device across a tubing string of said wellbore by removing a support member from said barrier device;

collapsing an articulably linked upper flapper/lower flapper arrangement at said barrier device such that said wellbore is blocked by said articulably linked upper flapper/lower flapper arrangement;

supporting said barrier device from a first direction; and supporting said barrier device from a second direction.

15. A method of controlling a flow or production fluids in a wellbore as claimed in claim 14 wherein said supporting of said barrier device from a pressure exerted on said barrier device from the first direction comprises shifting a support to position to prevent opening of the barrier device.

16. A method of controlling a flow or production fluids in a wellbore as claimed in claim 15 wherein said shifting said support comprises depressurizing a chamber at a downhole side of said barrier device.

17. A method of controlling a flow or production fluids in a wellbore as claimed in claim 15 wherein said shifting comprises mechanically shifting said support.

18. A method of controlling a flow or production fluids in a wellbore as claimed in claim 15 wherein said shifting comprises electrically shifting said support.

19. A method of controlling a flow or production fluids in a wellbore as claimed in claim 15 wherein said shifting comprises hydraulically shifting said support.

20. A method of controlling a flow or production fluids in a wellbore as claimed in claim 15 wherein said shifting comprises setting down weight on a line at which said barrier device is located.

21. A method of controlling a flow or production fluids in a wellbore as claimed in claim 14 wherein said supporting of said barrier device from a pressure exerted on said barrier device from the second direction comprises:

pressurizing said tubing string uphole from said barrier device, biasing a lock ring in a downhole direction to close said barrier device, and engaging said lock mechanism with a set of wicker threads.

22. A method of controlling a flow or production fluids in a wellbore as claimed in claim 14 further comprising opening said barrier device.

23. A method of controlling a flow or production fluids in a wellbore as claimed in claim 22 wherein said opening comprises unsupporting said barrier device.

24. A method of controlling a flow or production fluids in a wellbore as claimed in claim 23 wherein said unsupporting is unsupporting said barrier device from a pressure exerted from said first direction and from said second direction.

25. A method of controlling a flow or production fluids in a wellbore as claimed in claim 23 wherein said unsupporting is by shifting one or more supports.

26. A method of controlling a flow or production fluids in a wellbore as claimed in claim 22 wherein said opening of said barrier device comprises:

applying a pressure to said tubing string uphole from said barrier device, compressing a spring to cause a pin to translate through a milled profile in a downhole direction;

bleeding off the pressure in said tubing string to allow said pin to translate in an uphole direction; and un-supporting maid barrier device from the pressure exerted on said barrier device from the second direction.

* * * * *